US006305179B1

(12) United States Patent
Hirota

(10) Patent No.: US 6,305,179 B1
(45) Date of Patent: Oct. 23, 2001

(54) EXPANSION VALVE OF REFRIGERATING CYCLE CONSISTING OF CAPACITY VARIABLE COMPRESSOR

(75) Inventor: Hisatoshi Hirota, Hachioji (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/564,204

(22) Filed: May 4, 2000

(30) Foreign Application Priority Data

Jul. 12, 1999 (JP) ..... 11-197441

(51) Int. Cl.[7] ..... F25B 41/04
(52) U.S. Cl. ..... 62/225; 236/92 B
(58) Field of Search ..... 62/225, 228.4; 236/92 B

(56) References Cited

U.S. PATENT DOCUMENTS 4,979,372 * 12/1990 Tanaka ..... 62/225
5,060,485 * 10/1991 Watanabe et al. ..... 62/225
5,255,530 * 10/1993 Janke ..... 62/228.4
5,277,364 * 1/1994 Heffner et al. ..... 62/225
5,916,250 * 6/1999 Osthues et al. ..... 62/225

* cited by examiner

*Primary Examiner*—William E. Tapolcal
(74) *Attorney, Agent, or Firm*—Nilles & Nilles SC

(57) ABSTRACT

An expansion valve of a refrigerating cycle contains a compressor with variable capacity that hunts the flow of the refrigerant as soon as the expansion valve starts to open in a condition where the capacity of the compressor is varied. The variation of the cross-section of the passage of the refrigerant in the expansion over a selected amount of the moving stroke of a valve body of the expansion valve is less than the variation of the cross-section with another moving stroke amount of the valve body 53. The stroke section or stroke range with the reduced gradient of the variation of the cross-section extends between a position E in a fully closed state and a position F in a middle part of the opening stroke of the expansion.

12 Claims, 10 Drawing Sheets

Fig.8
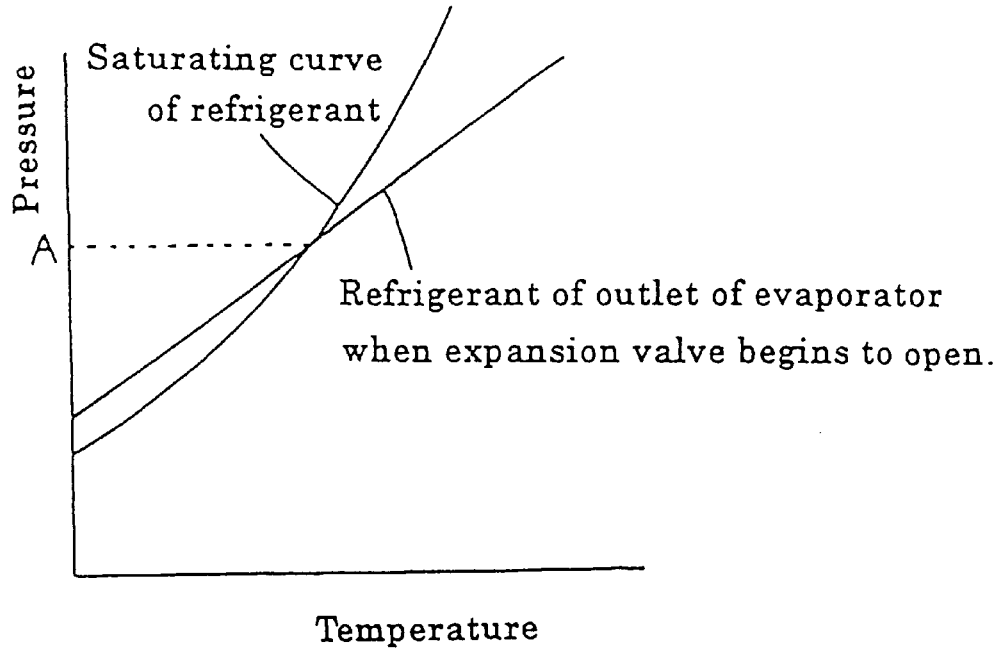
[Fig.9]
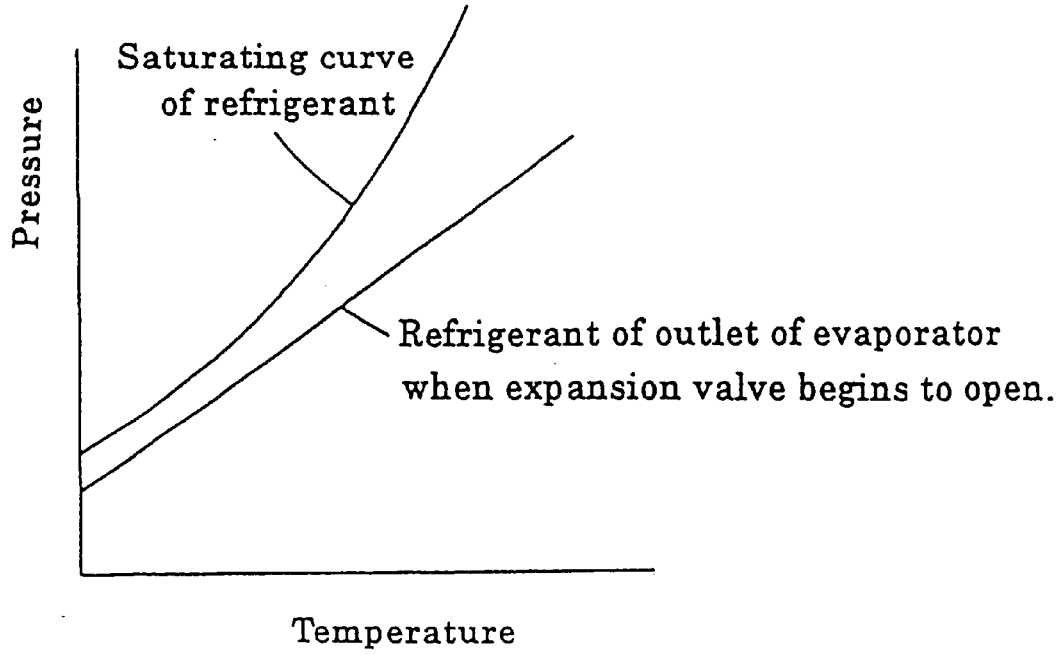

EXPANSION VALVE OF REFRIGERATING CYCLE CONSISTING OF CAPACITY VARIABLE COMPRESSOR

BACKGROUND OF THE INVENTION

The present invention relates to an expansion valve of a refrigerating cycle including a compressor with variable capacity.

As the compressor in a refrigerating cycle of an air-conditioning system of an automobile directly is driven by the engine, the speed of the compressor cannot be controlled individually. In order to obtain proper refrigerating ability, speed compressors with variable capacity are used (e.g., compressors of the inclined plate type, the rotary type or the scroll type). The capacity of the compressor is changed in correspondence to the pressure of the inhaled refrigerant or the inhalation pressure.

The expansion valve in a refrigerating cycle is controlled based on variation of the temperature and the pressure of low-pressure refrigerant supplied from the evaporator. Since the outlet of the evaporator directly communicates with the inlet of the compresor, the pressure of the refrigerant exiting the evaporator is equal to the inhalation pressure of the compressor. Any variations of the pressure at the outlet of the evaporator directly affect the inhalation pressure of the compressor. If the capacity of compressor is changed due to a variation of the inhalation pressure, and if then the expansion valve opens and closes suddenly, corresponding to the variation of the capacity of the compressor, the outlet pressure of the evaporator quickly varies. The degree of the variation of the capacity of the compressor is also amplified by variations of the inhalation pressure, since the compressor has to follow the inhalation pressure variations. This amplification leads to an undesirable hunting effect over a certain period of time, e.g. seconds up to several minutes in the flow of the refrigerant.

OBJECTIONS AND SUMMARY OF THE INVENTION

It is an object of the present invention to provide an expansion valve in a refrigerating cycle suppressing the hunting of the flow of refrigerant as soon as the expansion valve opens, corresponding with a condition according to which the capacity of the compressor is changed. The hunting either is suppressed entirely or at least significantly attenuated.

Within the expansion valve, the cross-section for the refrigerant passing to the evaporator is controlled differently within a first stroke section adjacent to the fully closed state position and within further stroke sections where the valve body already has been lifted farther from the valve seat bore. In particular, the variation of the cross-section within the first stroke section is smaller at any stroke increment of the valve body than at stroke increments of the same magnitude but in the further stroke section. In other words, during an opening stroke of the expansion valve, the gradient of the curve representing the increase of the cross-section through the valve, i.e. a specific variation per stroke increment, is flatter within the first stroke section and is steeper within any further stroke section. The same is true for the movement of the valve body in closing direction. This behavior of the expansion valve effectively controls hunting of the flow of the refrigerant when the capacity of the compressor is changed. Hunting is further controlled by setting the value of the pressure at the outlet of the evaporator for the moment where the expansion valve starts to open into a certain relation to the maximum inhalation pressure within the range where the capacity of the compressor is changed, particularly so that the pressure at the outlet of the evaporator then is equal or lower than the maximum inhalation pressure. This measure effectively suppresses the hunting effect and guarantees a sufficient cooling effect within the refrigerating cycle.

According to another object of the invention, the expansion valve includes a body with a prolongation diving into the valve seat bore within a first opening stroke section close to the fully closed state position such that a progressively increasing variation of the cross-section for the refrigerant only takes place in the second part of the stroke where the expansion valve opens more progressively. In other words, during the first opening stroke section, the valve body is co-acting with the valve seat bore like a flow regulator with a controlled throttling effect, control of the amount of refrigerant corresponding to a predetermined ramp function. This regulating measure is applied exclusively within the first stroke section and where the influence of the expansion valve for hunting is the strongest.

BRIEF DESCRIPTION OF DRAWINGS

A preferred exemplary embodiment of the invention is illustrated in the accompanying drawings in which like reference numerals represent like parts throughout, and in which:

FIG. 8 is a diagram of the relation between pressure and temperature illustrating a saturating curve of the refrigerant and the temperature/pressure characteristic curve of the refrigerant at the outlet of an evaporator and when the expansion valve begins to open according to the present invention;

FIG. 9 is a diagram of the relation between pressure and temperature illustrating a saturating curve of the refrigerant and another example of a temperature pressure characteristic curve of the refrigerant at the outlet of the evaporator and as soon as the expansion valve begins to open according to the present invention;

DETAILED DESCRIPTION OF THE PREFERRED EMBODIMENT

Figure 1:
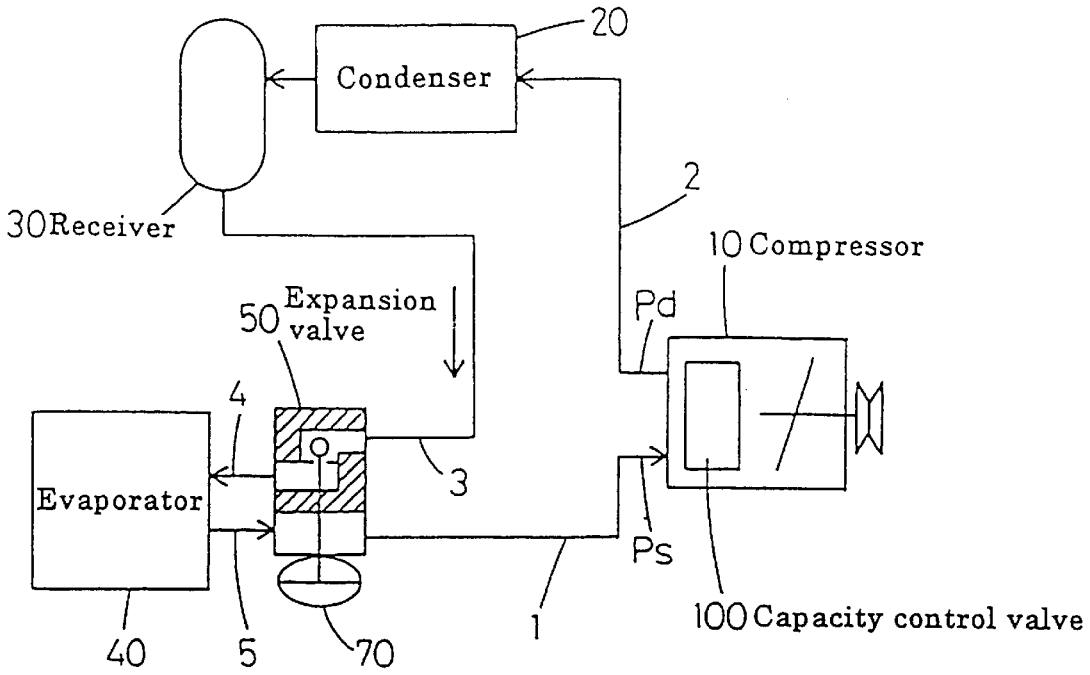
FIG. 1 is a block diagram of a refrigerating cycle according to the present invention.

Referring to FIG. 1, a refrigerating cycle as used in an air-conditioning system of an automobile includes a compressor 10 with variable capacity (the amount of the discharge). The capacity is changed corresponding to the inhalation pressure Ps of the refrigerant at an inhalation duct 1. Inhalation pressure Ps is controlled by a capacity control valve 100. High-pressure refrigerant having a discharge pressure Pd and as compressed by compressor 10 is supplied in a discharge duct 2 into a condenser 20. Already condensed and liquified refrigerant is temporarily stored in a receiver 30 with an amount corresponding to the initial circulation condition.

From receiver 30, high-pressure refrigerant in liquid form is supplied via a pair of high-pressure refrigerant ducts 3, 4 to an evaporator 40. Ducts 3, 4 define a first refrigerant passage in an expansion valve 50 which controls the flow of the refrigerant that is expanded adiabatically. Low-pressure refrigerant passing through evaporator 40 is evaporated and returned via a second passage 5 in expansion valve 50 to inhalation duct 1 of compressor 10. The temperature and the pressure of the refrigerant are sensed at the outlet of evaporator 40 by a temperature and pressure sensitive power element 70 of expansion valve 50. Power element 70 serves to control the expansion valve opening and closing stroke depending on variations of the pressure-temperature of the low-pressure refrigerant in second passage 5 of expansion valve 50.

Figure 2:
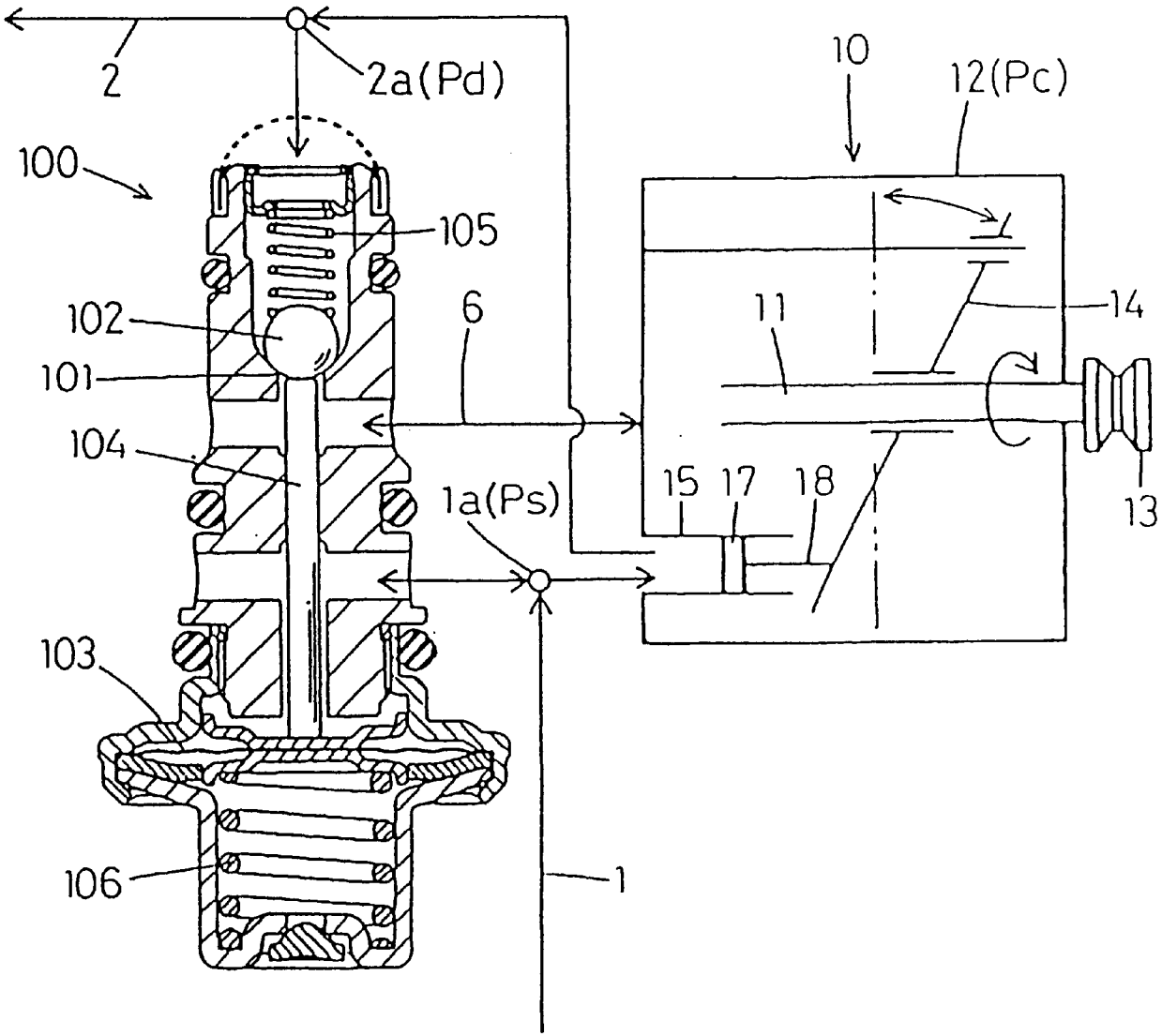
FIG. 2 is a schematic cross-section of a compressor and a capacity control valve defining and actuation pressure shift means according to a first embodiment of the present invention.

Referring to FIG. 2, compressor 10 includes a rotatable shaft 11 driven by a belt pulley 13 and disposed in an airtight crank room 12. Shaft 11 serves to drive a fluctuation board 14 disposed in crank room 12. Upon rotation of shaft 11, fluctuation board 14 rocks depending on its inclination in relation to the axis of shaft 11. At least one piston 17 is reciprocally disposed in a cylinder 15 in crank room 12. Piston 17 is connected by a rod 18 to board 14. Refrigerant is inhaled from an inhalation room 1*a* into cylinder 15. Inhalation room 1*a* communicates with inhalation duct 1. After compression of the refrigerant in cylinder 15, the compressed high pressure refrigerant is discharged into a discharge room 2*a* communicating with discharge duct 2.

The inclination angle of fluctuation board 14 is changed in accordance with a pressure Pc in crank room 12. The amount of discharged refrigerant, i.e. the capacity of the compressor 10, is changed according to the inclination angle of the fluctuation board 14. When Pc equal Ps (minimum Pc), compressor 10 is adjusted into the state of minimum capacity. This is shown by the dash/dotted position of board 14. Capacity control valve 100 is situated in a block surrounding compressor 10, (e.g., in a coaxial multistage bore (not shown)). A valve seat 101 is provided in the middle of a communicating passage between crank room 12 and discharge room 2*a* (high-pressure side). A spherical valve body 102 is disposed opposite to valve seat 101 at the side of discharge room 2*a*. Valve body 102 surveys the communication and is moveable between open and closed state positions.

A diaphragm 103 separates an inner space of valve 100 communicating with inhalation room 1*a* from an outer space which is sealed and contains a reference pressure. Between a receiving plate which is moveable together with a diaphragm 103 and a valve body 102, a central rod 104 interconnects valve body 102 and diaphragm 103 for common movement. Compression coil springs 105 and 106 load diaphragm 103 in an opening direction of valve body 102 and in a closing direction, respectively. Since diaphragm 103 is displaced corresponding to variations of inhalation pressure Ps in relation to the reference pressure loading diaphragm 103, valve body 102 follows these movements.

As soon as inhalation pressure Ps drops below a fixed pressure, valve body 102 is separated from valve seat 101. Discharge pressure Pd is brought from discharge room 2*a* into crank room 12, and control pressure Pc in crank room 12 rises. The capacity of compressor 10 is low.

As soon as control pressure Pc in crank room 12 is higher than said fixed pressure value, valve body 102 is seated on valve seat 101 and the capacity of compressor 10 is adjusted to a maximum capacity, since crank room 12 communicates via a small leak passage (not shown) with inhalation room 1*a*. Leak passage control pressure Pc in crank room 12 drops gradually when valve body 102 is seated such that after a while valve 102 again will be lifted. Consequently, control pressure Pc in crank room 12 is continuously controlled by the value of the inhalation pressure Ps and the amount of the capacity of compressor 10 corresponding to the value of the inhalation pressure Ps.

Figure 3:
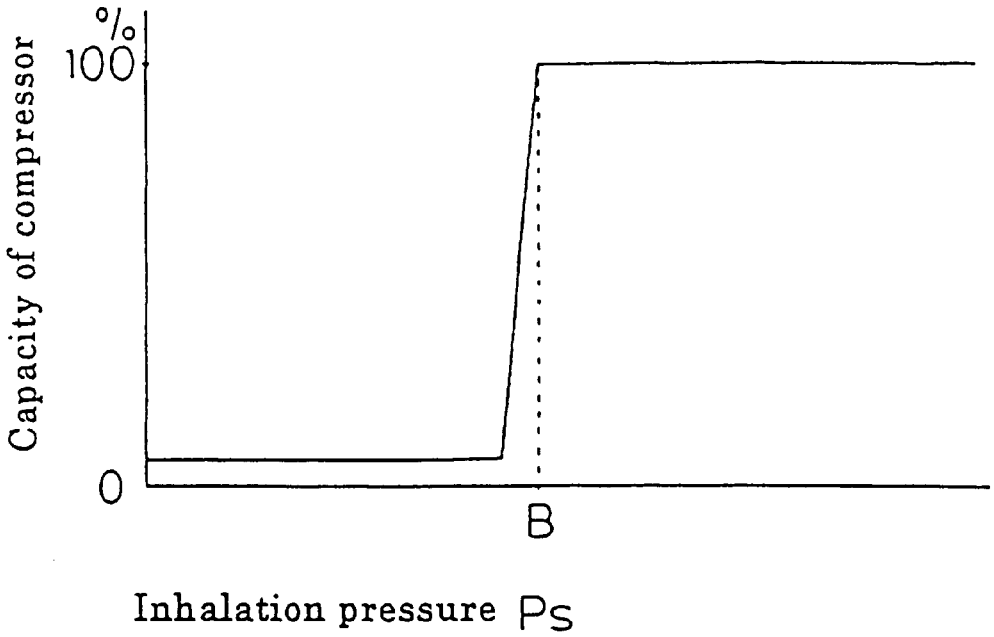
FIG. 3 is a diagram representing the capacity of the compressor in relation to inhalation pressure as an illustration of capacity control characteristics of the compressor according to a first embodiment of the present invention.

In FIG. 3 illustrates the relation between the capacity and the inhalation pressure Ps, wherein value B is the maximum inhalation pressure within the range in which the capacity of the compressor 10 changes. As soon as inhalation pressure Ps gradually drops below value B, with the compressor 10 running with maximum capacity, the capacity automatically starts to decrease.

Figure 4:
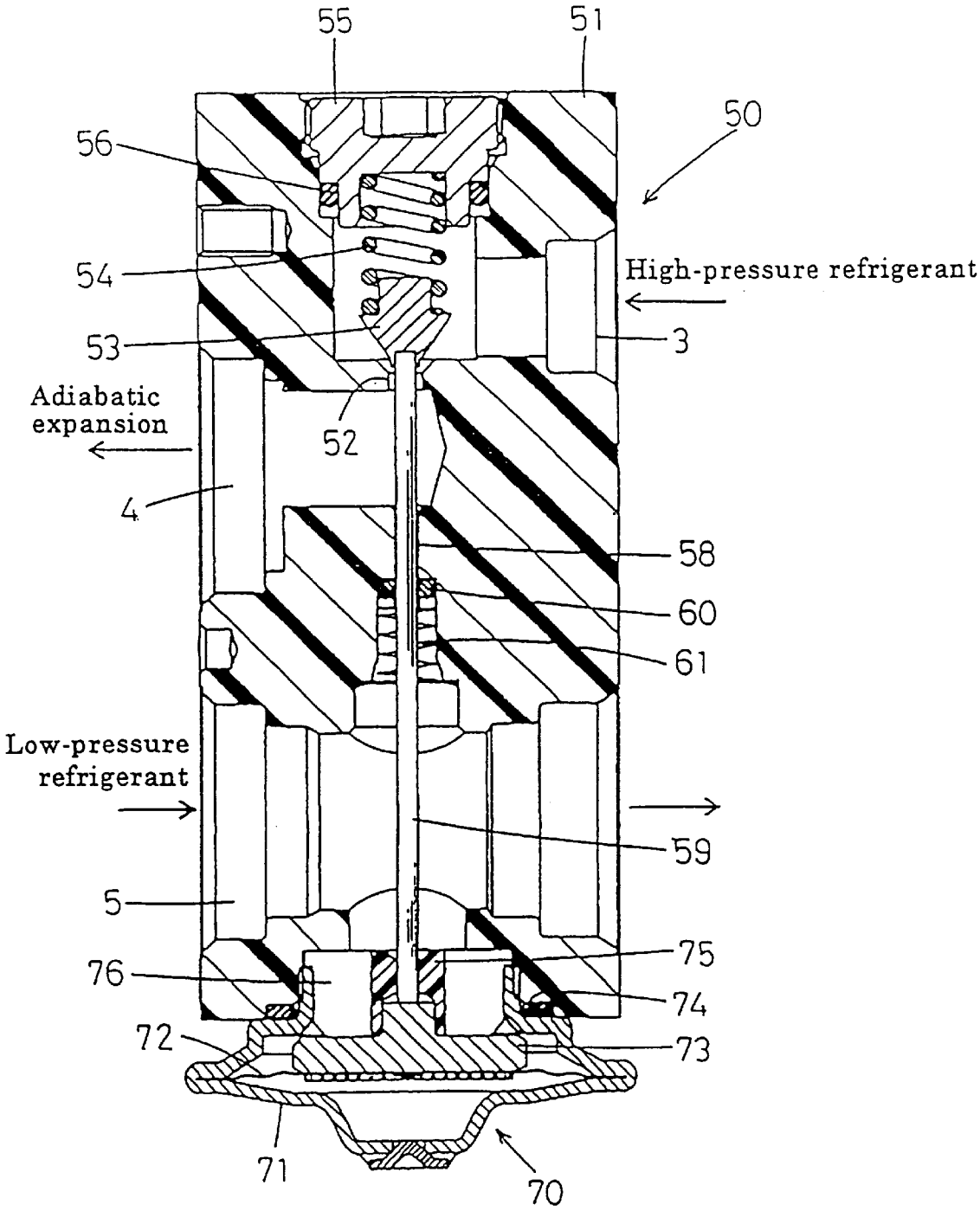
FIG. 4 is a longitudinal sectional view of an expansion valve according to a first embodiment of the present invention.

Expansion valve 50 in FIG. 4 has a main body block 51 with second passage (outlet duct 5 of evaporator 40) for the flow of low-temperature and low-pressure refrigerant gas as supplied from evaporator 40. Main body block 51 includes a first passage (duct 3) into which high-pressure and high-temperature refrigerant fluid is supplied from receiver 30. The fluid is supplied into inlet duct 4 of the evaporator and the supply of the fluid is carried out adiabatically. Second passage (outlet duct 5) directly communicates with inhalation duct 1 of compressor 10. The refrigerant pressure in the outlet duct 5 of the evaporator 40 (outlet pressure of the evaporator 40) is equal to inhalation pressure Ps of compressor 10.

The first refrigerant passage 3 in main body block 51 has the form of a crank wherein a contracted portion of the first passage has a valve seat bore 52. In alignment with valve seat bore 52, a penetrating bore 58 is formed between the first and second passages. Penetrating bore 58 receives a retractable actuation rod 59, one end of which is connected to a valve body 53 associated with valve seat bore 52 within the first passage at the side of high-pressure refrigerant duct 3. Valve body 53 is loaded by a compression spring 54 in a closing direction. The other end of actuation rod 59 is in driving connection with a power element 70. Power element 70, having a temperature sensing room is installed in an opening part of main body block 51 in alignment with penetrating bore 58. Power element 70 is at least partially in temperature and pressure transmitting contact with the refrigerant within said second passage 5 of main block 51. The section of the first passage extending between valve seat bore 52 and inlet duct 4 to evaporator 40 serves to adiabatically expand the high-pressure refrigerant.

Compression coil spring 54 is supported by an adjusting nut 56 screwed into a mounting opening of main body block 51. By adjusting nut 56, the pre-load or energization force of compressing coil spring 54 is adjusted on demand. An O-ring 56 serves to seal this region.

Actuation rod 59 abuts valve body 53 and passes through valve seat bore 52 with radial clearance such that an annular flow passage is defined between valve seat bore 52 and said actuation rod 59.

As soon as valve body 53 is separated from valve seat bore 52 by pushing actuation rod 59 via power element 70 counter to the force of compression coil spring 45, the cross-sectional area for the passing of the high-pressure refrigerant increases. The size of the cross-sectional area depends on the stroke of valve body 53 or the amount of the stroke of actuation rod 59. Any variation of the cross-sectional area varies the flow or demand of refrigerant supplied to evaporator 40.

Actuation rod 59 is sealed within penetrating bore 58 by an O-ring 60 so that no refrigerant is allowed to leak between the first and the second passage. O-ring 60 is compressed by a small compression coil spring 61.

A thermal-sensitive room in power element 70 is closed by a diaphragm 72 fixed to a housing 71 made from relatively thick metal sheet material. Diaphragm 72 can be a thin metallic sheet, e.g. stainless steel sheet metal of a thickness of about 0.1 mm. At the other side of the thermal-sensitive room of power element 70, a plate 73 abuts diaphragm 72. The other end of actuation rod 59 abuts at the center of plate 73. An O-ring 74 seals the mounting opening for power element 70. The thermal-sensitive room contains a saturated vapor gas that is the same as the refrigerant in the refrigerating cycle or similar. A bushing 75 is stationarily fixed between power element 70 and the second passage of main body block 51. Bushing 75 is made of a plastic material or the like having low thermal conductivity. Bushing 75 is penetrated by a ventilation groove 76 in order to establish a communication between the second passage and the surface of diaphragm 72 outside thermal-sensitive room. Low-pressure refrigerant within the second passage of main block 51 is allowed to pass through ventilation groove 76 towards diaphragm 72 such that the temperature of the refrigerant within the second passage (the refrigerant exiting the evaporator 40) is slowly transmitted to power element 70.

Valve body 53 includes a cone-shaped end part with a bore at the top of the cone into which the lower end of actuation rod 59 engages. A slanted surface of the conical end part of valve body 53 has a smaller cone angle than the cone angle of the tapered surface formed a t an entrance section of valve seat bore 52.

Figure 5:
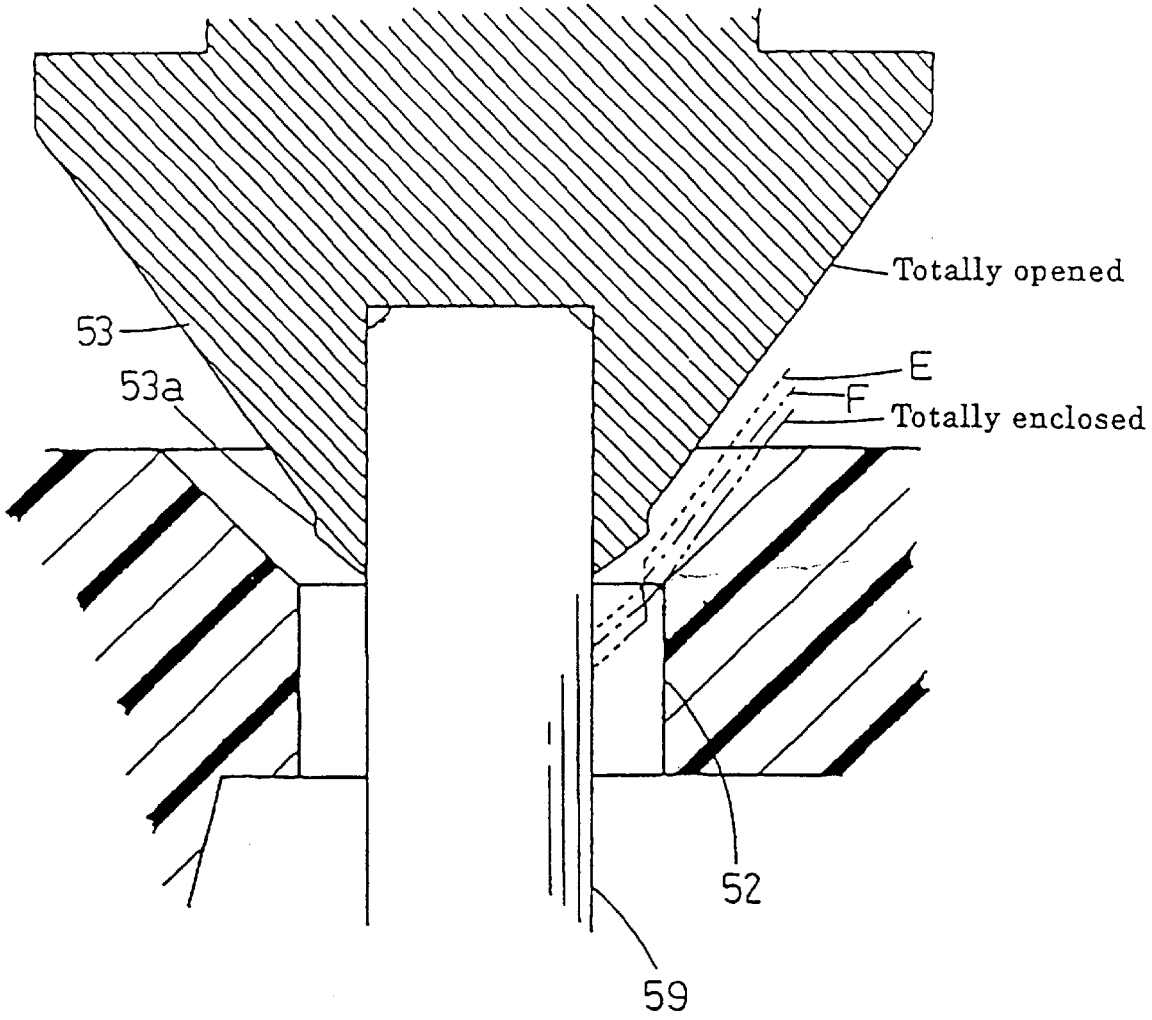
FIG. 5 is a sectional illustration of an enlarged longitudinal section of the expansion valve of FIG. 4 according to the present invention.

As shown in FIG. 5 at the conical end of valve body 53, which conical end is defining a conical or convexly rounded seat surface, a bump 53*a* in the form of a protrusion for diving into seat valve bore 52 is provided, the outer diameter of which is smaller that the inner diameter of valve seat bore 52 in its cylindrical section, continuing the tapered surface defining the entrance portion of valve seat bore 52.

The peripheral and cylindrical surface of bump 53*a* is parallel with the shaft line of actuation rod 59 and to the inner wall of the cylindrical section of valve seat bore 52. The cone angle of the slant surface of the protrusion has a cone angle which is larger than the cone angle of the seat surface or conical part of valve body 53. Valve seat bore 52 has a circular closure edge at the transition between the cylindrical bore action and its tapered entrance section. The conical seat surface of valve body 53 seats on the closure edge in the fully closed state position. In the fully closed state position, protrusion or bump 53*a* is diving into the cylindrical section of valve seat bore 52.

By the shape of valve body 53, the variation of the cross-section between valve body 53 and valve seat bore 52 is linear within a stroke rang e between position E where bump 53*a* begins to enter or dive into valve seat bore 52 and the fully opened state position (maximum opening stroke).

Figure 6:
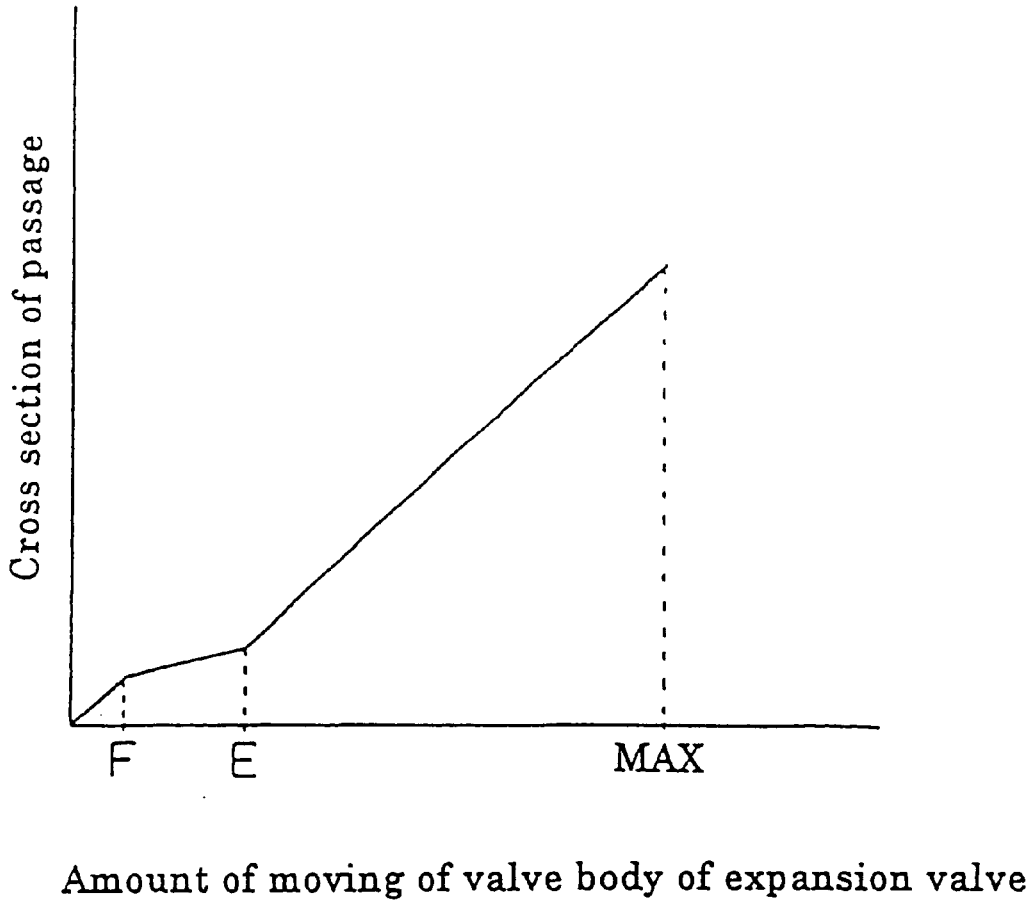
FIG. 6 is a diagram of the cross-section of the flow passage in an expansion valve in relation to the stroke of the valve body in relation to a valve seat bore according to the present invention.

However, as shown in FIG. 6, within a first stroke range E to F (FIGS. 5 and 6), the variation of the cross-section of the passage for the refrigerant is much smaller than the amount of the stroke movement of valve body 53. First stroke range E to F extends between an opening state position E where bump 53*a* begins to dive into the cylindrical section of valve seat bore 52, and an opening state position F where bump 53*a* already has entered the cylindrical bore section of valve seat bore 52 by a considerable amount, and valve body 53 already has closed the valve to some extent. In the remaining stroke section between opening state position F and the fully closed state position, the relation between the stroke amount of valve body 53 and the variation of the cross-section of the passage is similar to outside first range E to F.

The extent of the valve body moving stroke between the fully closed state position and the opened state position F extends between about 10% to 30% of the total stroke of valve body 53 into its fully opened state position. Within the first stroke section between positions F and E, the variation of the cross-section of the passage for the refrigerant is smaller in relation to the amount of the moving stroke of the valve body 53 than the variation of the cross-section within the amount of the moving stroke between the fully closed state position and position F and between position E and the fully opened state position. In other words, the gradient of the variation of the cross-sectional area in relation to the stroke movement of valve body 53 is flatter within stroke section F to E and is steeper in the stroke section between the fully closed state position and F to E and is steeper in the stroke section between the fully closed state position and position F as well as between the opened state position E and the fully opened state position (MAX).

If position F is too close to the fully closed state position, or if position E is too close to the fully opened state position, the moving stroke amount of valve body 53 is too large and causes endurance problems. Therefore, positions E and F are situated within the above-mentioned limits.

A rate of the variation of the cross-section for the moving stroke amount of the valve body 53 between positions F and E is less than one half of the rate of variation of the cross-section over the other ranges. This controls hunting in the flow of the refrigerant. Since it is complicated to achieve a variation of the cross-section between positions F and E smaller than one fourth than the variation of the cross-sections in the other stroke sections due to manufacturing limits or the like, a variation of the cross-section between position F and E amounting to between one fourth to one half of the variation of the cross-section in the other stroke section is preferable. Even if the upper limit of the variation of the cross-section between positions F and E is less than two thirds of the variation of the cross-section in the other stroke section, this effectively controls hunting.

Figure 7:
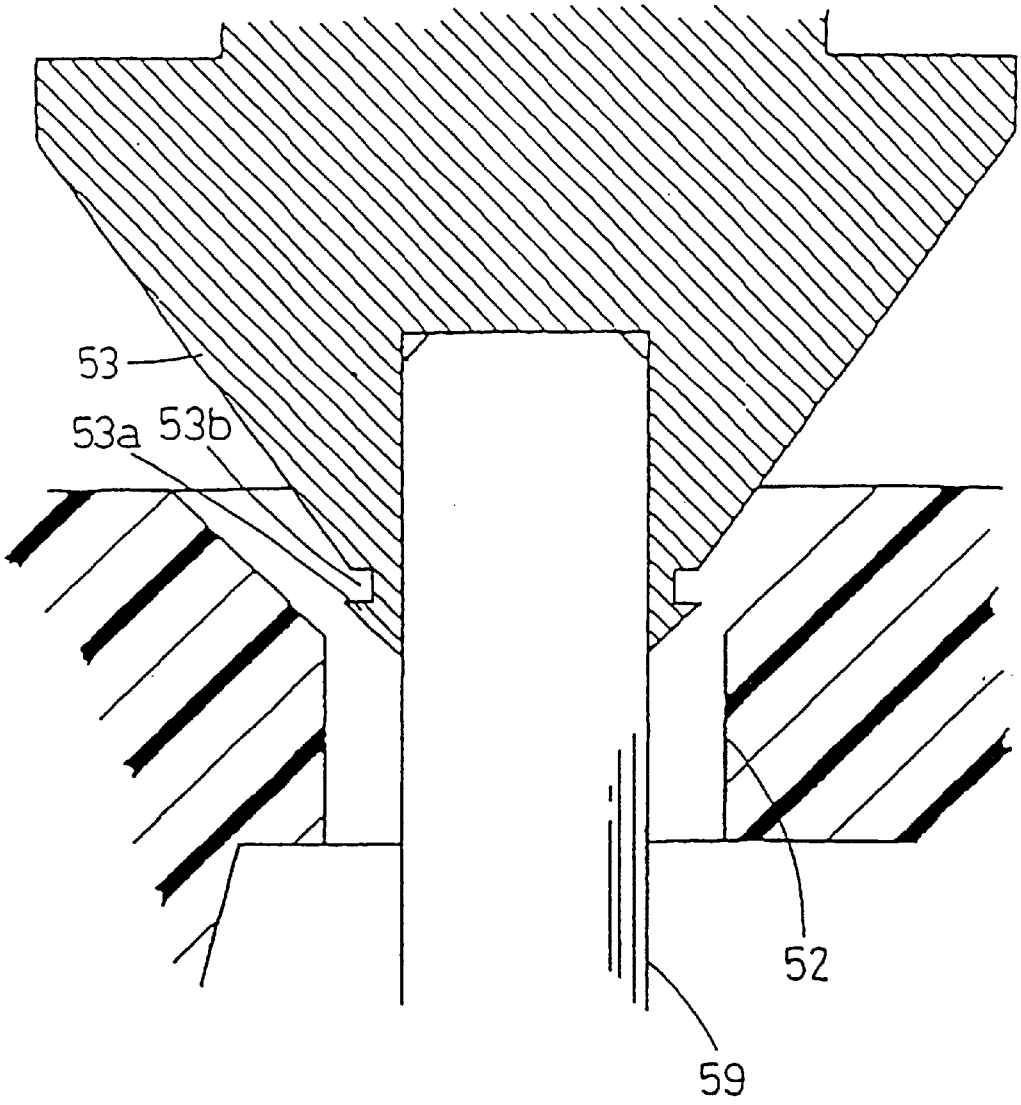
FIG. 7 is a sectional illustration of an enlarged longitudinal section according to a second embodiment of the present invention.

In an alternative embodiment shown in FIG. 7, the transition between the protrusion or bump 53*a* and the conical seat surface of valve body 53 is defined by a constricted part of circumferential groove 53*b*, thereby reducing the rate of variation of the cross-section between positions F and E in relation to the rate of variation of the cross-section in the other stroke sections.

In the temperature/pressure diagram of FIG. 8, a saturating curve of the refrigerant (the refrigerant circulated through the refrigerating cycle) is shown, as well as a characteristic curve of the refrigerant in outlet duct 5 of evaporator 40 when valve body 53 of expansion valve 50 starts to open from its fully closed state position. Both curves intersect each other at a point A, representing a value of the pressure of the refrigerant in outlet duct 5 of the evaporator that is essentially equal to the initial inhalation pressure Ps of compressor 10.

Provided that the value B in the diagram of FIG. 3 of inhalation pressure Ps is the value at which the capacity of the compressor 10 will decrease from maximum capacity, the capacity will not decrease when valve body 53 of expansion valve 50 starts to open (assuming value A in the diagram of FIG. 8 is higher than value B of the maximum inhalation pressure B in the diagram of FIG. 3 in a range where the capacity of compressor 10 should change). In this case, hunting of the flow of the refrigerant will not occur. However, in case of high load on the refrigerating cycle, the achievable effect of air-conditioning will not satisfy and it will be hard to cool sufficiently. Even a liquid phase of the refrigerant fluid will be forced to return to compressor 10. Therefore, in order to achieve a sufficient air-conditioning effect, the value A is equal or smaller than B.

If in a conventional refrigerating cycle a setting is made to have value A equal or smaller than value B, hunting of the flow of the refrigerant may occur, because the capacity of compressor 10 will change immediately when valve body 53 of the expansion valve 50 begins to open.

However, as according to the invention, sharp variations of the flow of the refrigerant are suppressed, the flow of the refrigerant is continuously controlled, and hunting does not occur, since the variation of the cross-section of the passage for the refrigerant in relation to the lift stroke amount of valve body 53 is small within the first stroke range between positions F and E when the expansion valve opens as mentioned above. The positive control or suppression of sharp flow variations through expansion valve 50 are achieved when the characteristic curve of the refrigerant exiting evaporator 40 (as soon as expansion valve 50 begins to open) does not cross the saturating curve of the refrigerant as shown in FIG. 9. In this case, hunting will controlled or suppressed.

Figure 10:
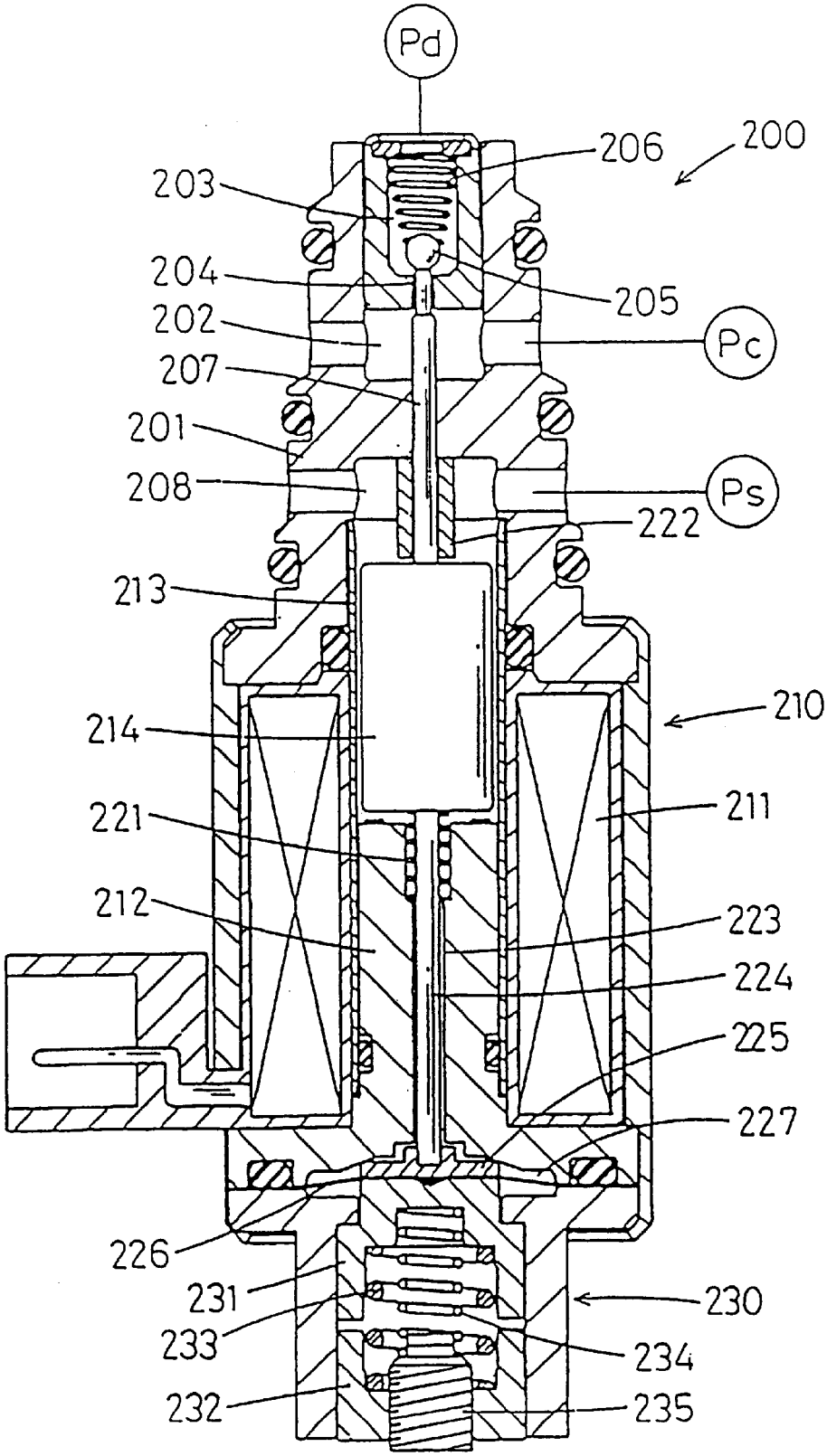
FIG. 10 is a longitudinal section of a capacity control valve of the compressor according to another embodiment of the present invention.

FIG. 10 depicts another embodiment of a capacity control valve 200 used in a refrigerating cycle of another embodiment of the invention. Capacity control valve 200 controls the capacity of compressor 10 in correspondence to inhalation pressure Ps. The point where the capacity of the compressor starts to change is the same as described above. However, with capacity control valve 200 of FIG. 10, it is possible to arbitrarily shift by a solenoid 210 the range of the inhalation pressure Ps where the capacity of the compressor starts to change. The further configuration of the refrigerating cycle is the same as in the preferred embodiment of the present invention.

In FIG. 10 in a middle region of a cylinder 201 of a main body, a crank room communicating part 202 is formed communicating via a side bore with crank room 12. An end part of cylinder 201 defines a discharge room communicating part 203 communicating with discharge room 2*a* via an axial opening. Between parts 202 and 203, a central axis valve bore 204 is provided co-acting with a spherical valve part 205 located in part 203. Part 203 receives a weak compression coil spring 205 loading valve ball 205 to keep it at the opening of valve ball 204 as long as valve ball 205 is not pushed upwardly into part 203 against the force of spring 206 by a valve driving rod 207 penetrating valve bore 205 with radial clearance through.

Main body 201 further includes an inhalation room communicating part 208 communicating through a side bore with inhalation room 1*a*. Valve driving rod 207 extends to the center of a diaphragm 226. A solenoid 210 includes a stationary electromagnetic coil 211, a stationary fixed iron core 212 at the side of diaphragm 226 and a moveable iron core 214 loosely engaging in one end of inhalation chamber communicating part 208. Moveable iron core 214 is loosely inserted in a sleeve 213 extending inside solenoid 210. An end surface of valve driving rod 207 abuts and end surface of moveable iron core 214. Rod 207 is continued by coaxial rod 221 extending between the other end surface of moveable iron core 214 and the center of a plate 225 abutting diaphragm 226. A compression coil spring 221 is disposed between moveable iron core 214 and fixed iron core 212. Spring 221 has a stronger spring force than compression coil spring 206 in part 203.

If there is no other force than the force of compression coil spring 221 acting on the moveable iron core 214 and rod 207, valve ball 205 is lifted from valve bore 204 and is brought into its fully opened state position. A stopper 222 serves to limit the maximum opening stroke of valve ball 205.

As soon as electric current is supplied to electromagnetic coil 211, moveable iron coil 214 is attracted by fixed iron core 212 counter to the force of spring 221 causing valve ball 205 to seat on valve bore 204.

Diaphragm 226 is installed at the lower end of fixed iron core 212 facing plate 225. The outer surface of diaphragm 226 is free to ambient air pressure. A space 227 inside diaphragm 226 (between diaphragm 226 and the lower end of fixed iron core 212) communicates through a penetrating bore 223 with inhalation room communication part 208. Space 227 is part of the inhalation room communicating part 208.

A pressurizing mechanism 230 is provided serving to load diaphragm 226 with a reference pressure in a direction towards fixed iron core 212. A moveable piston 231 abuts the outer surface of diaphragm 226. Compression coil springs 223 and 234 are provided between moveable piston 231 and a spring counter fort 232 which can be adjusted to finely adjust the acting forces of compression coil springs 234.

Inhalation pressure Ps is applied on the inner surface of diaphragm 226. The ambient air pressure and the force of compression coil springs 233 and 234 is applied similar to the reference pressure. The resulting difference pressure is applied by diaphragm 226 to plate 225 and rod 224.

If electric current is supplied to electromagnetic coils 221 of solenoid 210, the pressure acting on plate 225 acts via rod 224 and moveable iron core 214 at valve driving rod 207. Valve ball 205 is controlled to open and close corresponding to variations of inhalation pressure Ps. As a consequence, the capacity of compressor 10 is controlled. The value of the inhalation pressure Ps for a change between the opened and closed conditions of valve ball 205 are varied or shifted by varying the value of the electric currents for electromagnetic coil 211 to arbitrarily shift the response point for the initiated capacity change.

Figure 11:
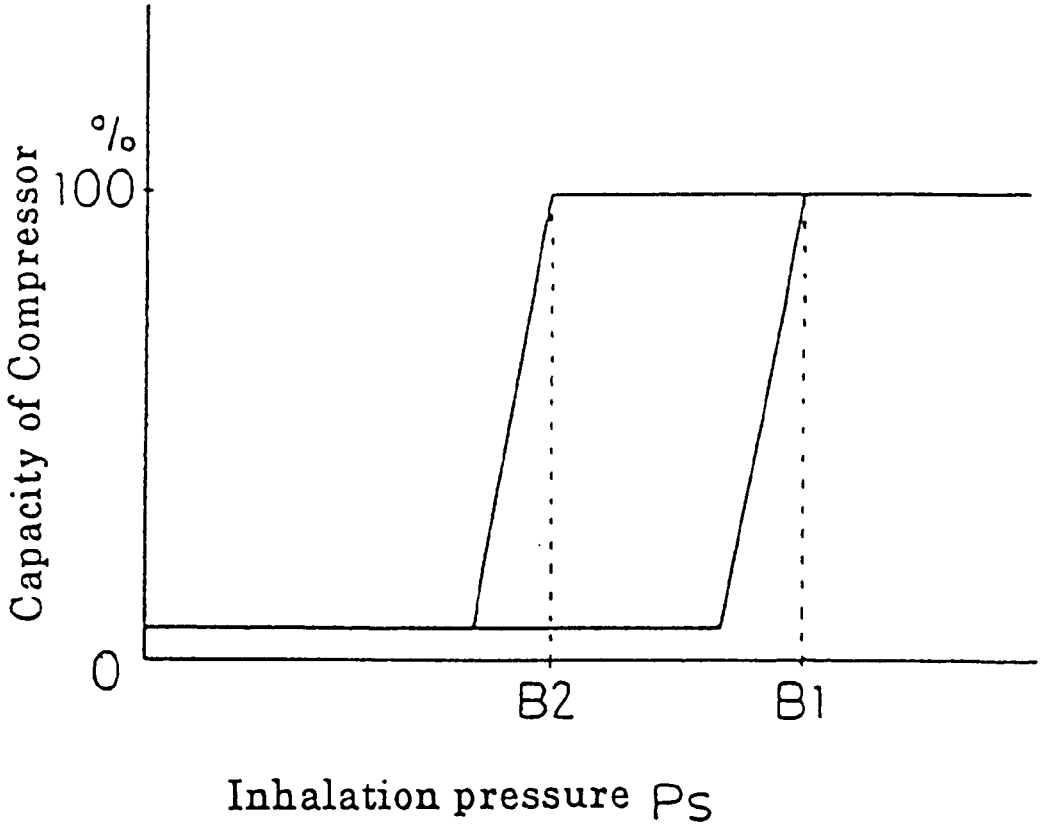
FIG. 11 is a diagram of the relation between the capacity of the compressor and the inhalation pressure representing a capacity control characteristic diagram of the compressor according to another embodiment of the present invention.

In the diagram of FIG. 11 (relation between capacity and inhalation pressure Ps of the compressor 10, the capacity of which is controlled by capacity control valve 200), pressure value B1 is a maximum inhalation pressure where the capacity is changed when the range of the inhalation pressure Ps is shifted to the side of the maximum by capacity control valve 200. Pressure value B2 is the maximum inhalation pressure in the range where the capacity is changed under the condition that the range of the inhalation pressure Ps by which the capacity of the compressor is changed is shifted to the side of the minimum by capacity control valve 200.

Pressure values A and B1 are predetermined such that pressure value A equals or is smaller than pressure value of B1 as shown in FIG. 8 so that hunting can be effectively controlled. If further pressure value A is equal or smaller than pressure value B2, it is possible to control hunting of the flow of refrigerant and to simultaneously achieve a cooling ability even in the conditions where the range of the inhalation pressure Ps and where the capacity is changed.

A balance between a satisfying cooling effect and the hunting control of the flow of the refrigerant is achieved by selecting the pressure value A to a proper pressure value between pressure value B1 and the pressure value B2 (pressure B2 equal or smaller than pressure value A equal or smaller than pressure value B1).

Compressor 10 with a variable capacity needs not to be an included board type, but may instead be a rotary type, a scroll type or the like.

The scope of the application is not to be limited by the description of the preferred embodiments described above, but is to be limited solely by the scope of the claims that follow.

What is claimed is:

1. An expansion valve in a refrigerating cycle comprising:

a compressor with a variable capacity corresponding to variations of the compressor inhalation pressure;

an expansion valve having a valve body disposed in a high pressure passage for high-pressure refrigerant supplied to an evaporator adjacent to a valve seat bore formed by a contraction in a middle portion of the high pressure passage;

wherein the position of the valve body is controlled between a fully closed state and an opened state corresponding to variations of temperature and pressure of low-pressure refrigerant exiting the evaporator and passing through the expansion valve in a low-pressure passage;

wherein a variation of a cross-section of the high pressure passage between the valve body and the valve seat bore for a first stroke increment of a lift stroke of the valve body from the fully closed state to an intermediate opening state position is smaller than a variation of the cross-section of the high pressure passage for a second stroke increment of the lift stroke from the intermediate opening state position to the opened state.

2. An expansion valve according to claim 1, wherein the first stroke increment of the lift stroke of the valve body in relation to the valve seat bore at approximately the fully closed state position extends between about 10% to 50%, optionally between 10% to about 30%, of the entire valve opening stroke, and wherein the variation of the cross-section of the high pressure passage for the refrigerant within the first stroke increment is about two-thirds smaller than the variation of the cross-section within the second stroke increment.

3. An expansion valve according to claim 1, wherein the first stroke increment at approximately the fully closed state position of the valve body extends between about 10% to 50%, preferably 10% to 30% of the total valve opening stroke, and wherein the variation of the cross-section of the high pressure passage for the refrigerant within the first stroke increment is about one-fourth to one-half of the variation of the cross-section in the second stroke increment.

4. An expansion valve according to claim 1, wherein a temperature/pressure characteristic diagram of the refrigerant contains a saturating curve of the refrigerant and a characteristic curve of the refrigerant at an outlet of the evaporator when the valve body beings to open, and wherein the characteristic curve of the refrigerant remaining within an entire range of varying pressure or varying temperature does not intersect at any point below the saturating curve.

5. An expansion valve in a refrigerating cycle comprising:

a compressor, the capacity of which is variable corresponding to variations of the compressor inhalation pressure;

an expansion valve having a first refrigerant passage for high-pressure refrigerant to be supplied to an evaporator, and a second refrigerant passage for low-pressure refrigerant exiting the evaporator, a valve seat bore within the first passage and a valve body associated with the valve seat bore for a moving stroke in relation to the valve seat bore between a fully closed state position and a fully opened state position and into an intermediate opening state position, the valve body being driven through a total valve lift stroke by a temperature and/or pressure sensitive power element provided in temperature and pressure communication with the second passage;

wherein the total valve lift stroke of the valve body in an opening direction is divided into a first stroke section and at least one further stroke section, the first stroke section beginning at the fully opened state position to the fully closed state position, the at least one further stroke section beginning at an end of the first stroke section; and wherein a variation of the cross-section within the first stroke section between the valve body and the valve seat bore for a first stroke increment is smaller than a variation of the cross-section for a second stroke increment of the same magnitude as the first stroke increment within the at least one further stroke section.

6. An expansion valve according to claim 5, wherein the first stroke section extends from about 10% to about 50% of the total lift stroke.

7. An expansion valve according to claim 5, wherein said first stroke section extends from about 10% to about 30% of the total lift stroke.

8. An expansion valve according to claim 5, wherein the variation of the cross-section with a first stroke increment within the first stroke section is about one-fourth to about one-half of the variation of the cross-section within the second stroke increment of the same magnitude as the first stroke section within the at least one further stroke section.

9. An expansion valve according to claim 5, wherein the variation of the cross-section within the first stroke section is less than about two-thirds of the variation of the cross-section within the at least one further stroke section.

10. An expansion value according to claim 5, wherein the valve seat bore is formed with an axial cylindrical bore section terminating at a circular closure edge facing the valve body;

wherein the valve body is formed with a conical or convexly rounded seat surface for a tight contact co-action with the closure edge in the fully closed state position; and wherein the seat surface is prolonged by a plunger protrusion coaxial with an axis of the cylindrical bore section, the plunger protrusion having a smaller outer diameter than an inner diameter of the closure edge.

11. An expansion valve according to claim 10, wherein the plunger protrusion is formed with a cylindrical peripheral surface with a circular transition into the seat surface, and with a conical end surface, a cone angel of which is larger than a cone angle of the cylindrical peripheral surface at the circular transition.

12. An expansion valve according to claim 5, wherein the valve body is secured to an end of an actuation rod passing through the valve seat bore with radial clearance, and wherein the actuation rod and a cylindrical bore section define an annular refrigerant passage within a contraction of the first refrigerant passage.

* * * * *